US011518664B2

(12) United States Patent
Matheyka et al.

(10) Patent No.: US 11,518,664 B2
(45) Date of Patent: Dec. 6, 2022

(54) FILLING APPARATUS

(71) Applicant: KHS GmbH, Dortmund (DE)

(72) Inventors: Thomas Matheyka, Eppstein (DE); Hilmar Fickert, Kriftel (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 17/297,576

(22) PCT Filed: Dec. 5, 2019

(86) PCT No.: PCT/EP2019/083854
§ 371 (c)(1),
(2) Date: May 27, 2021

(87) PCT Pub. No.: WO2020/126523
PCT Pub. Date: Jun. 25, 2020

(65) Prior Publication Data

US 2021/0395065 A1 Dec. 23, 2021

(30) Foreign Application Priority Data

Dec. 20, 2018 (DE) ..... 102018133126.6

(51) Int. Cl.
*B67C 3/00* (2006.01)
*B67C 3/34* (2006.01)

(52) U.S. Cl.
CPC ..... *B67C 3/007* (2013.01); *B67C 3/34* (2013.01)

(58) Field of Classification Search
CPC ..... B67C 3/007; B67C 3/34; B67D 1/0075; B67D 1/0412; B67D 1/0406; B67D 2001/0098; B67D 1/1252; B67D 1/00; B67D 1/04; B67D 1/0829
USPC ..... 141/18
See application file for complete search history.

(56) References Cited

U.S. PATENT DOCUMENTS

| | | | | |
|---|---|---|---|---|
| 2007/0169834 | A1 | 7/2007 | Monzel | |
| 2007/0215235 | A1* | 9/2007 | Ranalletta | B65B 3/003 141/2 |
| 2014/0216604 | A1* | 8/2014 | Clusserath | B67C 3/004 141/277 |
| 2017/0088408 | A1* | 3/2017 | Fickert | B67C 3/34 |
| 2020/0239296 | A1* | 7/2020 | Krulitsch | B08B 9/0813 |

FOREIGN PATENT DOCUMENTS

| | | | |
|---|---|---|---|
| DE | 3813410 | A1 | 11/1989 |
| DE | 202009001197 | U1 | 6/2010 |
| DE | 102014106203 | A1 | 11/2015 |
| JP | H06148022 | A * | 6/1994 |
| WO | 2014170699 | A2 | 10/2014 |
| WO | 2015169579 | A1 | 11/2015 |

OTHER PUBLICATIONS

JPH06148022A—English Translation (Year: 1994).*
International Search Report, PCT Application No. PCT/EP2019/083854, dated Mar. 12, 2020 (3 pages).

* cited by examiner

*Primary Examiner* — Timothy P. Kelly
*Assistant Examiner* — Christopher M Afful
(74) *Attorney, Agent, or Firm* — Occhiuti & Rohlicek LLP

(57) ABSTRACT

A filling device includes an evaluation device that is connected by a data line to pressure sensor and that detects an opening pressure of a keg or of a keg fitting, compares it with stored reference pressure data, and chooses, based on the result of the comparison, between allowing the keg to be filled and preventing the keg from being filled.

18 Claims, 3 Drawing Sheets

FILLING APPARATUS

RELATED APPLICATIONS

This is the national-stage application under 35 USC 371 of international application PCT/EP2019/083854, filed on Dec. 5, 2019, which claims the benefit of the Dec. 20, 2018 priority date of German application DE 102018133126.6, the contents of which are incorporated herein by reference.

FIELD OF INVENTION

The present invention relates to filling machines, and in particular, to filling a keg.

BACKGROUND

A typical keg has a mouth valve and a keg fitting. Usually, the keg fitting has a spring.

To open the keg, it is necessary to overcome the spring's force. The pressure required to open the keg is referred to as the "opening pressure."

The process of opening a keg includes having an actuator actuate a plunger that presses against a keg fitting. In some cases, gas pressure forces a piston through a cylinder in the course of opening a keg fitting.

A variety of kegs are known, among which are reusable kegs and single-use kegs. A single-use keg is usually made of a thin plastic such as PET. A reusable keg has a substantially stronger will made of metal.

Because of the differences between their respective walls, single-use kegs are filled with a filling pressure of between 2 and 3 bar. In contrast, reusable kegs are filled at filling pressures between 3 and 4½ bar.

SUMMARY

It is the object of the invention to provide a filling apparatus and a method that detects the nature of the keg that it is being filled and that identifies a defect in the keg.

According to the invention, the filling apparatus described heretofore contains an evaluation device, which is connected by a data line to at least one pressure sensor, and which is configured such as to detect the opening pressure of a keg or of its mouth valve respectively. That is to say, to detect the actuating pressure in the pressure chamber and/or the force on the plunger or piston at which the keg fitting opens. The detection of the opening pressure or the force, as explained hereinafter, is possible by means of the pressure curve and, as applicable, in connection with the position of the plunger or piston. The evaluation device is also configured such as to compare this detected opening pressure with at least one stored reference pressure or reference pressure curve, and, depending on the result of the comparison, either to admit the keg for the filling process or to screen it out.

By the detection of the opening pressure and the comparison with at least one, and preferably several, stored reference pressures or reference pressure curves, it is possible from the outset for defective or incorrect kegs to be screened out. For example, if a resetting spring of a keg fitting is broken, a keg exhibits too low a residual pressure, or the fitting of a single use keg is presented and opens under a lower reference pressure, for example below 2 bar, then this keg will be screened out and no longer admitted for a filling procedure. The same applies if the keg fitting does not open at all, i.e. the keg fitting does not open until a higher reference pressure is reached.

In this case it is assumed that the keg fitting is defective. For example, the closure may be heavily clogged or corroded. In this case too, the keg is no longer admitted for the filling procedure, and is screened out of the filling apparatus by means of a transport device. The invention can be used for carrying out this test for defective kegs either with single use kegs or reusable kegs, wherein the upper and lower reference values for these two different keg types are different.

With the reusable keg, the upper and lower reference value referred to are higher than with the single use keg, since in the structural respect the keg is closed with a more powerful spring and/or exhibits a higher residual pressure than is the case with single use kegs. Accordingly, the invention can also be used to differentiate between reusable kegs and single use kegs by way of the opening pressure which is to be applied. For example, if the opening pressure lies between 2 and 2½ bar, it is assumed that this relates to a single use keg. In this case, an incorrect keg could then subsequently be screened out, or the treatment stations can be wholly or partially deactivated. The main application lies in screening out defective or incorrect kegs, with which the keg fitting opens at too low an opening pressure, or does not open at all.

Preferably, the filling apparatus comprises a control device, which is configured such as to interrupt the filling process in whole or in part, depending on the result of the comparison, and, in particular, to screen the keg which in this way has been identified as incorrect out of the filling apparatus by means of a transport device, or screen it out of the transport segment downstream. If it is therefore determined that the opening pressure lies outside the reference pressure range, i.e. below the lower reference pressure or above the higher reference pressure, then the keg will not be admitted for filling, but will be immediately screened out of the filling apparatus, by means of the transport device. In this way, defective kegs can be identified and rapidly screened out of further processing.

As has already been described, the evaluation device is configured so as to admit a keg to the filling process if, preferably, the opening pressure lies above a lower reference pressure and below an upper reference pressure, i.e. within a permissible reference pressure range. By selecting the corresponding permissible reference pressure range for single use kegs or reusable kegs, it can be ensured that only correct or functioning single use kegs or reusable kegs are admitted for filling, in particular because the corresponding reference ranges for the opening pressure are different.

Preferably, the evaluation device is configured such as to evaluate the time curve of the actuating pressure, and to interpret a pressure maximum as an opening pressure. At the pressure imposition by the plunger, the pressure usually rises for a sufficiently long period until the counter-pressure of the counter-spring in the keg fitting and/or of the residual pressure in the keg are overcome and the keg fitting opens. At this moment, as a rule, the pressure drops off again. Accordingly, a pressure peak is obtained which is preferably interpreted as opening pressure. In this way the opening pressure can be identified by the pressure time curve alone.

In a further advantageous embodiment of the invention, at least one position sensor is provided for at least one position of the piston or plunger, in particular for the position at rest. The evaluation device in this case is configured so as to evaluate the signal from the position sensor for the detection of the opening pressure. With the rising actuating pressure, as soon as the resistance of the keg fitting or of the residual pressure has been overcome and the keg fitting opens, the plunger moves slightly out of its position of rest, which is detected by way of the position sensor. Accordingly, the evaluation device can detect the point of time of the opening by way of the position sensor, and therefore also the correlated opening pressure by way of the pressure sensor. The pressure curve over time and also the signal from the position sensor can of course be combined, in order to verify the identification of the point of time of opening.

The invention likewise relates to a method for the filling of single use and reusable kegs provided with keg fittings by means of a filling apparatus, which comprises a filling element which is to be combined with the keg fitting, with a filling pipe and with a plunger which is axially movable in the filling pipe by means of an actuating device, which is configured such as to interact with the keg fitting in order to open the keg. According to the invention, the opening pressure of the keg fitting is detected, and compared with at least one reference pressure or reference curve. As a function of the result of the comparison, the keg is admitted to the filling process or not. With regard to the advantages and special features of the invention, reference is made to the foregoing description of the filling apparatus according to the invention.

Preferably, the filling apparatus is interrupted as a function of the comparison result, and the keg is screened out of the filling apparatus by means of a transport device. In this way, for example, a defective keg can be identified when the opening pressure lies below a predetermined lower reference pressure, in which case the keg fitting is evidently defective, or no adequate residual pressure is present, or, on the other hand, the opening pressure lies above an upper reference pressure, or the keg has not yet opened when the upper reference pressure is exceeded, in which case the keg fitting is evidently jammed, clogged, or corroded, and therefore must likewise be screened out of the filling process.

Alternatively, it is also possible for single use kegs to be differentiated from reusable kegs because to reference opening value ranges for the two types of kegs clearly differ, since reusable kegs are filled at a higher pressure than single use kegs. The allocated residual pressures, as well as the reference value ranges, for reusable kegs therefore lie clearly above those of single use kegs.

As has already been described heretofore in connection with the filling apparatus, the opening pressure is preferably detected by way of the pressure time curve, in particular by a pressure peak, with a subsequent drop in the pressure curve. As an alternative or additionally, the opening pressure can be identified by way of the position of the plunger, since at the opening of the keg the plunger moves forwards slightly from its position of rest.

It is obvious to the person skilled in the art that the embodiments described heretofore can be combined with one another in any desired manner.

The actuating device is preferably hydraulic or pneumatic. It can alternatively also be electrically actuated. In that case, it is not the actuating pressure that is detected at the opening of the fitting, but, by analogy, the torque value or the electric current flowing through the motor at the opening of the keg fitting.

The following expressions are used as synonyms: Pressure source-pressure fluid source, wherein in this case, in general, filling is to be understood also as being the filling, over a period of time, with fluid or gaseous cleaning media, not only the filling with one or more products.

BRIEF DESCRIPTION OF THE DRAWINGS

The invention is described hereinafter by way of example, on the basis of the schematic drawings. The drawings show.

DETAILED DESCRIPTION

Figure 1:
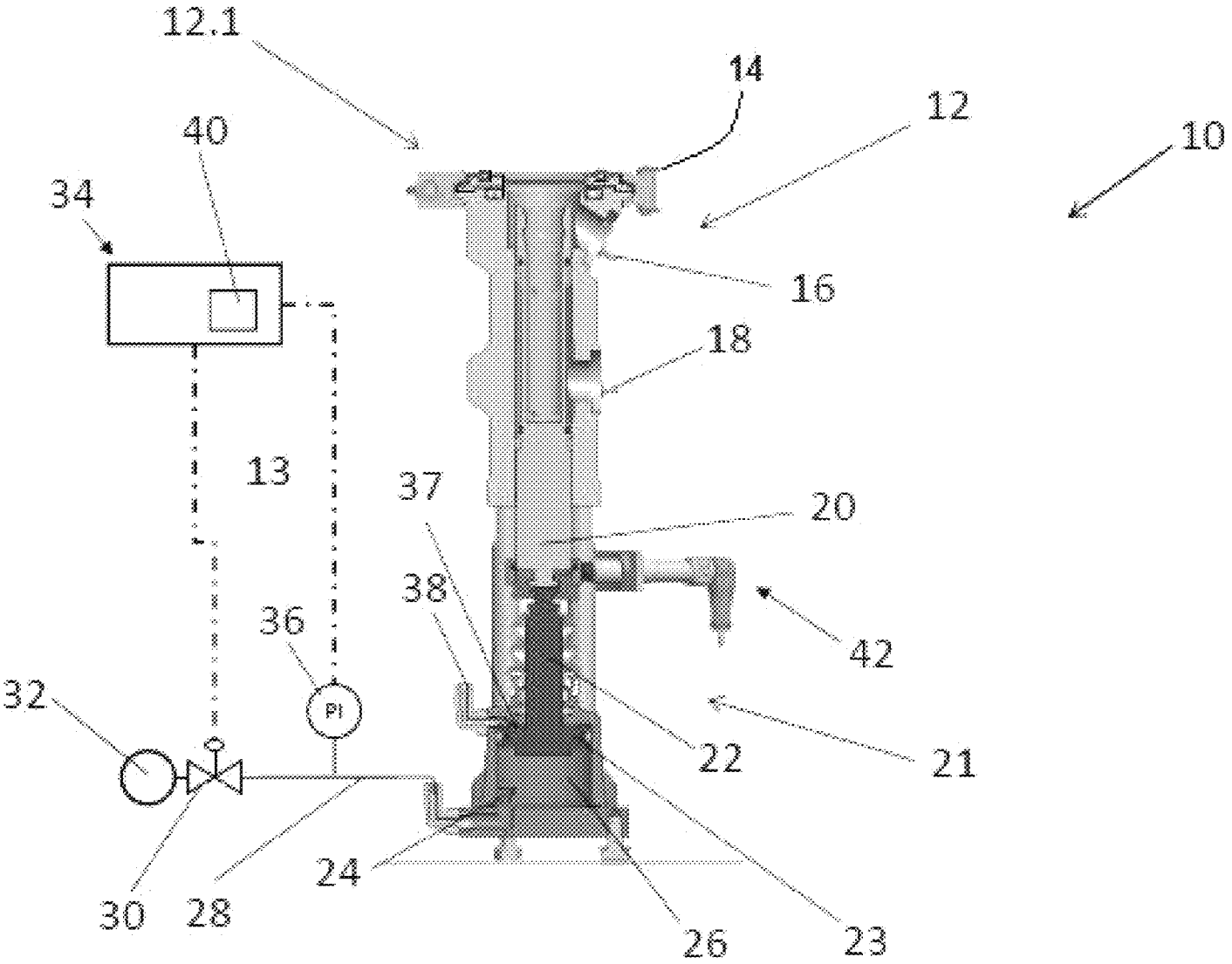
FIG. 1 A is a schematic view of a part of a filling apparatus.

FIG. 1 shows a filling element 10 of a filling machine. The filling element 10 includes a filling pipe 12. Both a product-delivery element 16 and a pressurized-gas delivery element open into the filling pipe 12. These permit pressure filling of the keg. The filling pipe 12 of the filling element 10 is flanged to a keg by an upper flange 14 at the pipe's free end 12.1. The keg that is to be filled, as well as other transport, carrying, and treatment elements, have been omitted for clarity.

Within the filling pipe 12, an actuator 21 moves a plunger 20 vertically along an axis. An actuator 21 comprises a piston 22 that moves through a hydraulic pressure cylinder.

At its first end, the piston 22 has a plate-shaped extension 23. The outer circumference of the extension 23 seals against the pressure cylinder's inner wall using a seal.

The extension 23 thus forms a lower pressure-chamber 26 in the pressure cylinder 24. The lower pressure-chamber 26 connects to a hydraulic pressure delivery line 28 via a control valve 30 that opens or closes based on instructions from a controller 34. The controller 34 thus controls communication of the lower pressure chamber 26 with a pressure source 32. The resulting control over pressure in the lower pressure-chamber 26 drives the piston 22, when then drives the plunger 20 so that it moves towards the free pipe end 12.1 or the flange 14 to thereby open the keg. These collectively form the plunger's actuating device 21.

Formed between the upper side of the plate-shaped extension 23 of the piston 22 and the upper side of the hydraulic cylinder is an upper pressure chamber 37, which cannot be seen in FIG. 1 due to the high position of the extension 23. Into this there opens a pressure discharge line 38, which in turn is likewise connected, by means of a control valve, not represented, to a pressure fluid container, e.g. the pressure source 32, in order to move the piston 22 downwards, in order to close the keg fitting after the filling process.

The controller 34 learns of the pressure within the lower pressure-chamber 26 from a pressure sensor 36 that connects to the pressure delivery line 28. Within the controller 34, evaluation circuitry 40 uses a pressure signal from the pressure sensor 36 to evaluate the actuating pressure over time in the lower pressure chamber 26.

The controller 34 receives further information from a position sensor 42 on the filling element. The position sensor 42 provides a position signal that has information on the plunger's position. This position signal is likewise available to the evaluation circuitry 40.

The filling process proceeds with the keg's keg fitting being pressed against the filling element 10 by a pressing device that presses against the keg's base. The control valve 30 than opens and pressurizes the lower pressure-chamber 36 via the line 28.

Figure 2:
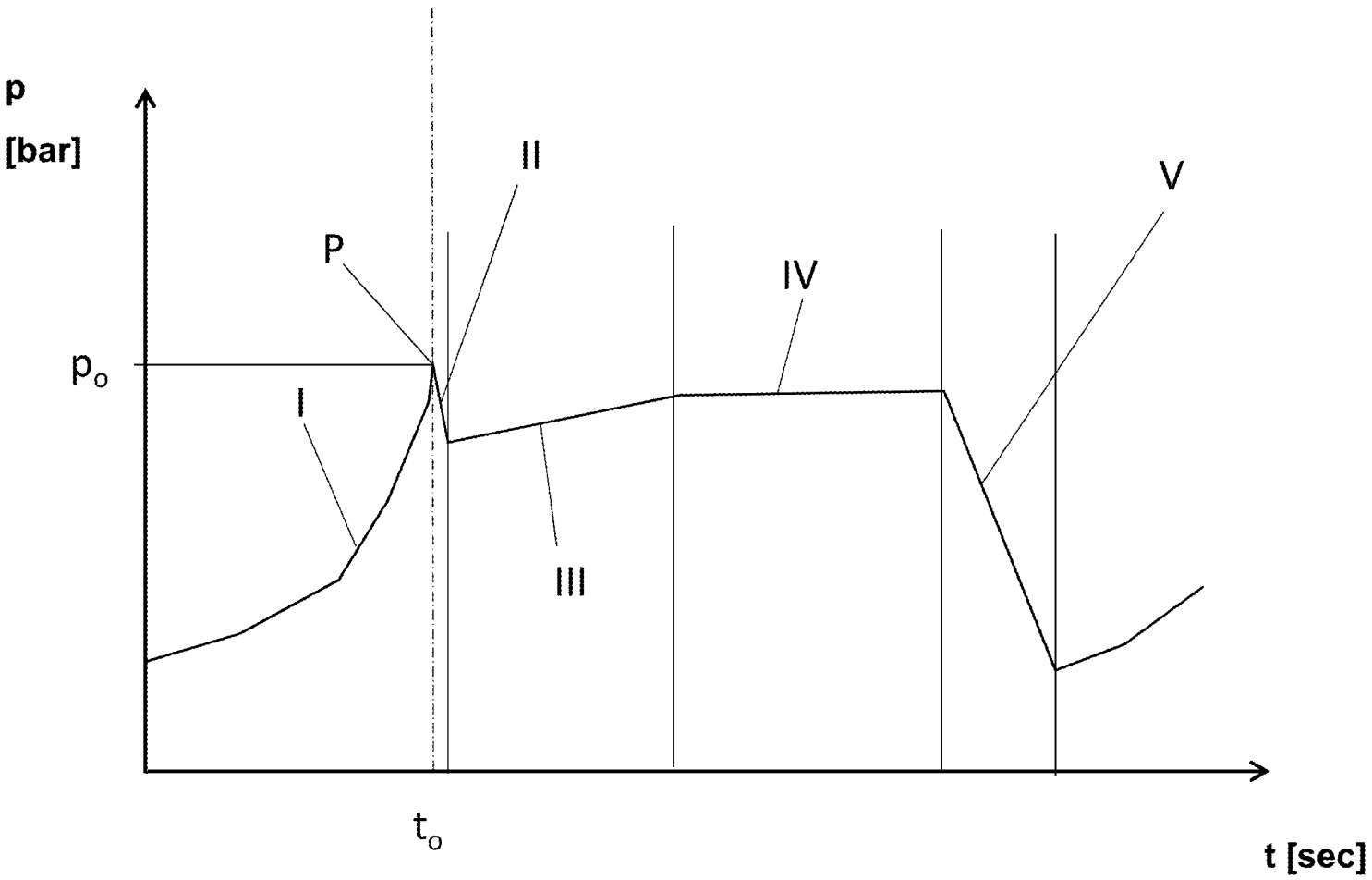
FIG. 2 shows pressure as a function of time during the filling of a keg, and FIG. 3 a shows permissible pressures for single-use kegs and reusable kegs.

FIG. 2 shows a typical signal provided by the pressure sensor 36 during a filling operation. The process begins at time zero with phase "I" in which pressure slowly rises until it reaches on opening pressure $p_o$ at time t0. Upon reaching the opening pressure $p_o$, the force exerted by the pressurized air becomes sufficient to force a spring in the keg fitting to open the keg. This cases a sudden pressure drop at phase "II" that begins when pressure reaches a peak "P".

As gas continues to enter the keg during phase "III," the pressure again begins to rise until it reaches a plateau at phase "IV". Minor pressure fluctuations that may occur during phase "III" and phase "IV" have been omitted for clarity.

At phase "V", the filling process is drawn to a close by reducing the pressure. This permits movement of the piston way from the keg fitting and eventual closure of the path to the pressure source.

Figure 3:
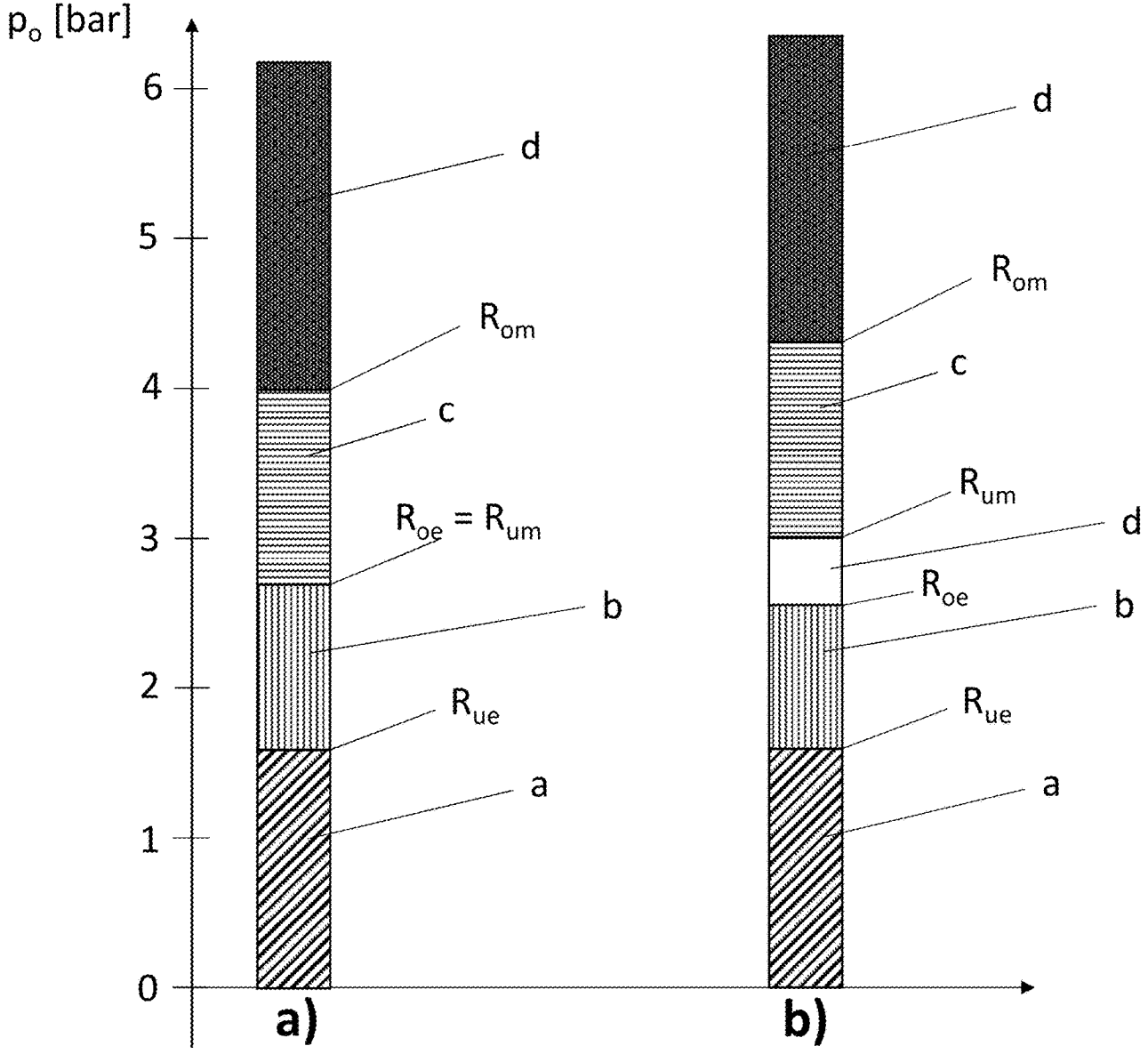

The brief spike in pressure "P" alluded to earlier serves as a prominent marker of the time that the keg fitting opened. This provides information on the opening time and the opening pressure $p_o$ that was required. This opening pressure $p_o$ and the pressure spike P are now compared with reference pressure ranges. FIG. 3 shows two reference-pressure ranges "a)" and "b)".

FIG. 3 shows first reference-pressures "a)" that specifies four reference ranges: range "a", range "b", range "c", and range "d." Range "a" is a lower range of impermissible pressures extending from 0 bar to approximately 1.6 bar. Range "b" represents permissible pressures for single-use kegs. Range "b" extends from approximately 1.6 bar to 2.6 bar. Range "c" extends above range "b". Pressures in range "c" are permissible for reusable kegs. This range extends from approximately 3 bar to 4.3 bar. Above range "c" is range "d", which is an upper range of impermissible pressures.

If the pressure sensor 36 detects an opening pressure $P_o$ within range "a", evaluation circuitry 40 assumes that the keg fitting as a whole is defective because it opened too early and below a minimum value. In this case the filling process or following process is interrupted and the keg fitting is screened out as defective.

The permissible reference pressure range "b" for single use kegs lies between a lower reference value $R_{ue}$ and an upper reference value $R_{oe}$. If the opening pressure $P_o$ moves in this reference pressure range "b", then it is assumed that this relates to a single-use keg. The upper reference pressure $R_{oe}$ for single-use kegs corresponds, in the example shown, to the lower reference pressure Rum for reusable kegs, which forms the lower limit for the permissible reference pressure range "c" for reusable kegs. Accordingly, a keg is identified as a reusable keg if the opening pressure lies between the lower reference pressure $R_{um}$ for reusable kegs and the upper reference pressure $R_{om}$ for reusable kegs.

If the opening pressure lies above the upper reference pressure value $R_{om}$ for reusable kegs, or if the keg fitting does not open at all, it is then assumed that the keg is likewise defective. As a result, it is screened out of the filling process.

It is therefore possible on the basis of the detection and evaluation of the opening pressure to differentiate both between defective kegs, such as those with worn-out keg fittings and keg fittings that will no longer open, as well as between single-use kegs and reusable kegs.

FIG. 3 also shows second reference-pressures "b)" but with a gap between range (b) and range (c).

The reference pressure ranges reproduced in FIG. 3*b* are essentially identical to those in FIG. 3*a*. The difference is a transitional range "e" separates the reference pressure ranges "b" and "c" for single use kegs and reusable kegs. As a result, the upper reference pressure $P_o$ for a single use keg is no longer identical to the lower reference pressure $R_{um}$ for reusable kegs.

Such a definition of the reference pressure ranges allows for a significant variation in the differentiation between single-use kegs and reusable kegs. In this situation the assumption is that, if the keg fitting opens in the pressure transition range, a keg fitting closure of a reusable keg is present but has a spring that is too weak to be used with a reusable keg. The keg is thus deemed defective and not filled.

Depending on the quality and/or safety considerations, the respective reference ranges can be defined as narrower or broader and can be provided accordingly on the control side.

The invention is not limited to the exemplary embodiments described but can be varied within the scope of protection of the claims which follow.

The invention claimed is:

1. An apparatus for filling a keg, said apparatus comprising a filling element, wherein said filling element comprises a filling pipe comprising a free pipe-end for engaging a keg fitting of said keg, a plunger that is arranged in said filling pipe and that is movable along an axial direction to interact with a retention spring of said keg fitting so as to open said keg, an actuator that causes axial movement of said plunger, and a pressurized region, said pressurized region comprising a pressure-delivery line and a pressure chamber, wherein said actuator comprises a piston, a cylinder, and said pressure chamber, wherein said piston connects to or forms said plunger, a control valve that connects said pressurized region to a pressure source that provides pressure for moving said piston towards said free pipe-end and towards said keg fitting, a pressure sensor for sensing an actuation pressure in said pressure chamber, and an evaluation device that is connected by a data line to said pressure sensor, said evaluation device being configured to detect, in said pressurized region, an opening pressure of a keg or of a keg fitting, to compare said opening pressure with stored reference pressure data, thereby generating a comparison, and to choose, based on said comparison, between allowing said keg to be filled and preventing said keg from being filled, wherein said evaluation device is further configured to detect said opening pressure by detecting a pressure peak.

2. The apparatus of claim 1, further comprising a controller that is configured to interrupt said filling process as a function of said comparison.

3. The apparatus of claim 1, wherein said evaluation device is configured to permit said keg to be filled based upon having determined that said opening pressure lies above a lower reference pressure and below an upper reference pressure.

4. The apparatus of claim 1, wherein said evaluation device is configured so as to evaluate a time curve of said actuating pressure and to interpret a pressure maximum on said time curve as an opening pressure.

5. The apparatus of claim 1, further comprising a position sensor for at least one position of said plunger, wherein said evaluation device is configured to evaluate a signal from said position sensor for detection of said opening pressure.

6. The apparatus of claim 1, wherein said evaluation device is further configured to determine that said actuating pressure is lower than said reference pressure.

7. The apparatus of claim 1, wherein said evaluation device is further configured to compare said opening pressure with a stored upper reference pressure and to determine that said upper reference pressure has been exceeded.

8. The apparatus of claim 1, wherein said evaluation device is further configured to detect said opening pressure of said keg fitting by detecting a position of said plunger.

9. The apparatus of claim 1, wherein said evaluation device is further configured to detect said opening pressure of said keg fitting by detecting a position of a part of said filling device that moves with said plunger.

10. The apparatus of claim 1, wherein said piston forms said plunger.

11. The apparatus of claim 1, wherein said piston is connected to said plunger.

12. The apparatus of claim 1, further comprising a lower pressure-chamber that connects to said pressure-delivery line via said control valve, wherein said cylinder comprises an inner wall, and wherein said piston comprises a plate-shaped extension having an outer circumference that seals said inner wall to form said lower pressure-chamber.

13. The apparatus of claim 1, further comprising an upper pressure-chamber that is connected to a pressure-discharge line for moving said piston to close said keg fitting, wherein said piston comprises a plate-shaped extension having an outer circumference that seals said cylinder's inner wall to form said upper pressure-chamber.

14. The apparatus of claim 1, wherein said evaluation device is further configured to detect that said keg is defective as a result of said keg fitting having opened at a minimum value of opening pressure.

15. The apparatus of claim 1, wherein said evaluation device is further configured to determine, based on said opening pressure, that said keg is a single-use keg.

16. The apparatus of claim 1, wherein said evaluation device is further configured to detect, based on said opening pressure, that said keg is a reusable keg.

17. The apparatus of claim 1, further comprising an upper flange at said free end.

18. The apparatus of claim 1, wherein said pressure is a time-varying quantity having a derivative having a sign and wherein said evaluation device is further configured to detect said opening pressure by detecting that said sign has changed from positive to negative.

* * * * *